US012421630B2

(12) United States Patent
Chen

(10) Patent No.: US 12,421,630 B2
(45) Date of Patent: Sep. 23, 2025

(54) ULTRASONIC ELECTROSPINNING FOR THE PRODUCTION OF FINE AND ULTRAFINE FIBERS

(71) Applicant: Virginia Commonwealth University, Richmond, VA (US)

(72) Inventor: Daren Chen, Glen Allen, VA (US)

(73) Assignee: Virginia Commonwealth University, Richmond, VA (US)

( * ) Notice: Subject to any disclaimer, the term of this patent is extended or adjusted under 35 U.S.C. 154(b) by 64 days.

(21) Appl. No.: 18/168,961

(22) Filed: Feb. 14, 2023

(65) Prior Publication Data

US 2024/0191400 A1 Jun. 13, 2024

(51) Int. Cl.
*D01D 5/00* (2006.01)

(52) U.S. Cl.
CPC ..... *D01D 5/0069* (2013.01)

(58) Field of Classification Search
CPC ... D01D 5/0069; D01D 5/0076; D01D 5/0007
See application file for complete search history.

(56) References Cited

FOREIGN PATENT DOCUMENTS

| | | | | |
|---|---|---|---|---|
| JP | 2010242251 A | * | 10/2010 | |
| JP | 2012224958 A | * | 11/2012 | |
| JP | 5134483 B2 | * | 1/2013 | |
| RU | 174492 U1 | * | 10/2017 | ..... B05B 17/06 |

* cited by examiner

*Primary Examiner* — Thu Khanh T. Nguyen
(74) *Attorney, Agent, or Firm* — WC&F IP

(57) ABSTRACT

Systems, devices, and methods employ advantages of ultrasonic vibration in the field of electrospinning. Fibers are produced from an ultrasonic nozzle exposed to an electric field established between the nozzle and a target object. Exemplary embodiments include electrospinning techniques that produce fine and ultrafine fibers in a high throughput via multiple jetting of spun solutions and melts. Ultrasonic vibration, in some instances combined with heating, reduces the voltage required for spinning. Vibrating power delivered to the nozzle may be selected so gas bubbles are generated by solvent cavitation in the spun solution. The bubbles are generated at the nozzle exit or else in such positions of the solution path so as to reach the nozzle exit where they further enhance multiple jetting of spun solutions.

13 Claims, 9 Drawing Sheets

ULTRASONIC ELECTROSPINNING FOR THE PRODUCTION OF FINE AND ULTRAFINE FIBERS

CROSS-REFERENCE TO RELATED APPLICATIONS

This patent or application claims the benefit of U.S. Provisional App. No. 62/386,749, filed Dec. 9, 2022, the complete contents of which are herein incorporated by reference.

FIELD OF THE INVENTION

Embodiments generally relate to electrospinning of fine and ultrafine fibers and, more specifically, electrospinning apparatuses and methods which leverage acoustic energy.

BACKGROUND

Due to its simplicity and low installation investment of setups, electrospinning has been proposed to produce fine and ultrafine fibers for various applications, e.g., filtration and separation, material research, patch drug delivery via patch/mat, biological scaffolds, and many others. While numerous works using electrospinning to produce ultrafine fibers with different functions have been reported, commercial applications of the technology have been limited, particularly for industries making profits only from large scale productions. This is because mass throughput of electrospinning is typically much lower than that offered by competitive technologies. A traditional spinning head may have only a single capillary and single fiber jet at any given time. Its limitation on the mass throughput is the major bottleneck for its industrial application.

Various head/spinneret designs have been proposed to achieve multiple jetting for increasing the mass throughput of electrospinning and thereby attempt to overcome the throughput issue. Due to the requirement of multiple jetting, many spinning head designs are very complicated and difficult to be consistently made.

In general, spinnerets for multiple fiber production via electrospinning are typically categorized as multi-needled and needle-less (or needle-free) spinnerets. Multiple needles or pointed tips are designed in needled spinnerets with the assumption that a single fiber is emitted from each needle/tip. Various body shapes of spinnerets were designed to uniformly place multiple needles/tips while keeping them sufficiently separated for concentrating the electrical field intensity at the needle exits. A difficulty with this approach is the requirement of a very uniform distribution of polymer solutions to each needle/tip to produce fibers in relatively uniform sizes from all of the separate needles. Furthermore, the construction of multi-needled spinnerets to have consistent needles/tips has been challenging from a manufacturing viewpoint as the number of needles/tips increases. Instead of using physical needles/tips, needle-free spinnerets produce fibers by producing multiple fibers from the crests of rippled liquid surface created by a physical means.

Ultrasonic spray nozzles have existed for some years for the purpose of atomizing liquids into fine droplets. For example, U.S. Pat. Nos. 4,659,014A, 4,655,393A, U.S. Pre-Grant Pub. No. 2008/0265055A1, and U.S. Pre-Grant Pub. No. 2014/0011318A1 describe various ultrasonic spray nozzles and related apparatuses. As these references demonstrate, the use of ultrasonic energy has been conventionally limited to spraying (electrospraying), that is to say the production of droplets. Commercially, companies such as Microspray™ sell ultrasonic spray nozzles for use in coating applications. Such spray nozzles are designed and employed exclusively for spraying and not viewed as viable implements for electrospinning.

U.S. Pat. No. 8,066,932 B2 describes a process of fabricating nanofibers by reactive electrospinning. The application of ultrasound is contemplated to increase chemical reactions rates, decrease apparent viscosity, and increase solubility. However, U.S. Pat. No. 8,066,932 acknowledges potential adverse effects from sonication, in particular a decrease to jet stability or other disruptions to the electrospinning process. To attempt avoiding these outcomes, the frequency and power of applied ultrasonic energy are kept low, and the ultrasonic transducer is positioned a considerable distance away from the electrospinning capillary exit to avoid vibration energy at the exit orifice.

Bubble electrospinning has been proposed to produce fibers. In the technique, the exits of spinnerets are faced upwards, and gas bubbles are introduced to the solution via injection. Due to the effect of gravity, gas bubbles slowly move to the surface of liquid located at the spinneret exit. The presence of gas bubbles at the liquid-gas interface forms rippled surfaces and reduces the surface tension of spun solutions. The setups of bubble electrospinning has the drawback of requiring a means to introducing fine gas bubbles into a spun solution and to ensure the injected gas bubbles arrive at the liquid-gas surface prior to its operation.

SUMMARY

Exemplary embodiments of this disclosure address the low throughput limitations of existing electrospinning technologies by leveraging the use of ultrasonic energy in combination with unique nozzles and electrospinning assemblies. Exemplary embodiments contradict the conventional understanding in the field that sonication is only compatible with spraying devices and processes.

Some exemplary embodiments involve spinnerets, heads, or nozzles and methods of electrospinning by which any one such device or method may simultaneously produce multiple fibers, sometimes referred to as multiple jetting, through the use of sonication. Production may be further scaled by embodiments comprising multiple nozzles each of which is able to jet multiple fibers at the same time.

Some exemplary electrospinning devices and methods may be applied to produce fibers with sizes in submicrometers (less than 1.0 μm) and even nanometers (less than 0.1 μm, sometimes referred to as nanofibers). An exemplary process produces fibers by exposing the exit of a spinning head, in which polymer solutions/melts are fed in, to an electric field having a high intensity in the space close to the head exit. Jetting from multiple locations of a spinning head is applied to increase the throughput of the process. A consequence of multiple jetting from a spinning head is the increase of voltage required to initiate the jetting (eventually reaching the threshold of surrounding gas). Different methods (e.g., introducing gas bubbles in spun solutions, sonication of spun solutions prior to spinning, heating) may be applied to reduce the surface tension of spun solutions for easing the multiple jetting (or initiating the jetting at low voltage).

According to some exemplary embodiments, ultrasonic vibration is applied to create waves on the polymer liquid surfaces of a nozzle. The crests of the vibrating waves serve as the tips for electrospinning. Under the ultrasonic vibration, the cavitation of liquids may also generate gas bubbles, making more irregular crests on the liquid surfaces. These are underlined mechanisms to increase the throughput of exemplary electrospinning methods. In addition, the heat input by the ultrasonic vibration to liquids reduces the viscosity of liquids, making the electrospinning operable at lower voltages (compared with no heating).

According to some exemplary embodiments, ultrasonic nozzles include disks which provide the exit surface, in contrast to the use of a single capillary with a pointed tip. It is also desirable in many embodiments to place the liquid close to the vibration surfaces so that the vibration energy can be effectively used for the crest generation. The vibrating surface does not need to be flat. For example, the vibrating surface may be or include a surface with multiple pointed extrusions to facilitate the delivery of the vibration energy to the liquid surface. Some embodiments may include a plate with multiple ultrasonic transducers attached at the bottom for exemplary electrospinning.

The present disclosure includes exemplary methods for inducing multiple jetting of spun solutions/melts and simultaneously reducing the surface tension of spun solutions by the ultrasonic vibration, heating, and/or introducing gas bubbles in spun solution without gas bubble injection.

Some exemplary embodiments may include a nozzle assembly configured so that a high voltage can be applied without affecting the nozzle operation. Such an exemplary nozzle assembly may provide improvement on the ultrasonic nozzles that are on the electrical ground (for the protection of the nozzles due to the construction of nozzle assembly and the connection to the ultrasonic generator). The operational voltage may be further reduced in some embodiments by application of the high voltage on the spinning nozzle instead of the target.

According to an exemplary embodiment, an ultrasonic nozzle comprises at least one exit surface, one or more channels for conducting liquid to the exit surface, and one or more ultrasonic generators arranged to vibrate the exit surface such that the liquid on the exit surface forms into a standing wave. The one or more ultrasonic generators are configured to generate ultrasonic vibration which is sufficient in combination with an electric field at the exit surface to induce jetting of fibers from peaks of the standing wave. The electric field alone, without changes to its parameters such as electric field intensity, may in some embodiments be insufficient on its own to induce satisfactory jetting of fibers. The electric field intensity may be too weak on its own to induce jetting. The electric field in combination with the vibrational energy supplied by the ultrasonic generators is sufficient to induce satisfactory jetting.

Vibrations supplied to the jetting nozzle may be synchronized with the fiber production process. Tuning the vibration frequency may be used to improve stability of fiber production. In some embodiments production of fibers may be produced randomly in so far as their jetting positions are not fixed. Some of the different peaks of the wave on the liquid meniscus may jet at different times from one another. This is a result when the standing wave is permitted to change and have variations over time. In some embodiments, a feedback control system may be included. The feedback control system may include at least one camera which yields a feedback signal of the exit surface and liquid meniscus. The feedback signal is monitored for changes in the standing wave induced by the acoustic vibrations and/or changes in the fiber jetting positions relative to, e.g., the exit surface. Fluctuations or variations in the standing wave detected from the feedback signal trigger an adjustment to the vibration frequency (and/or other parameters of one or more acoustic energy sources) to reduce or eliminate continued occurrence of the variations. The standing wave is thereby stabilized and the jetting positions are thus likewise stabilized.

Fibers produced by devices and methods of this disclosure are suitable for a variety of applications and industries. For example, fibrous media are usable in various filtration products for the removal of particulate matter (PM) in gases. The reduction of pressure drop while maintaining a high particle collection efficiency for filtration products remains one of the key directions for the filtration industry. This objective may be achieved by constructing the filter media with fine and finer fibers. Non-polymer nanofibers may be made as well for various other applications (e.g., environmental, worker and public health protection, and so on).

DETAILED DESCRIPTION

Figure 1:
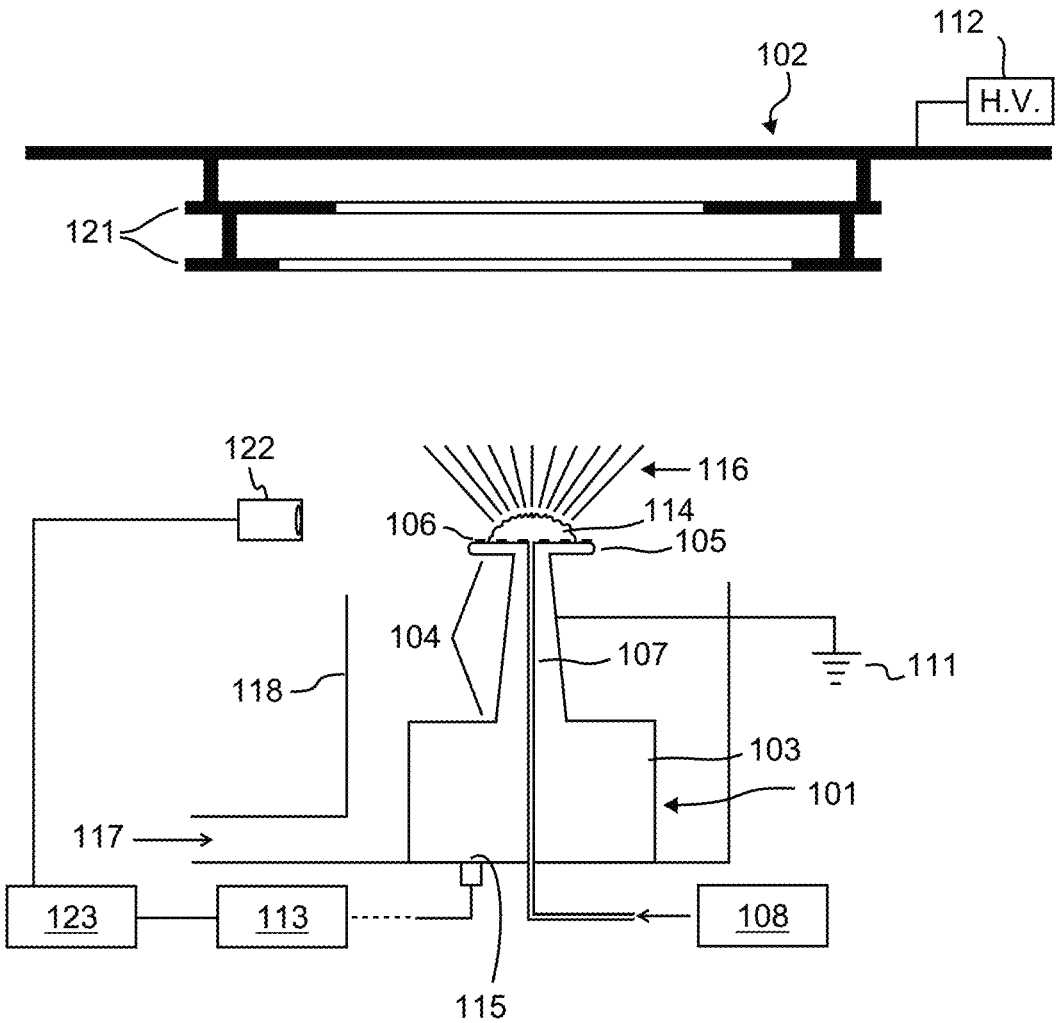
FIG. 1 is a schematic diagram of an exemplary ultrasonic electrospinning system for the production of fibers.
Figure 2A:
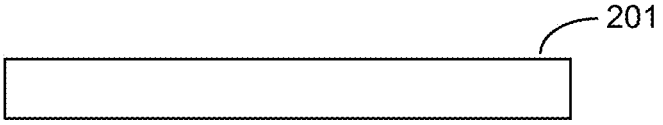
FIGS. 2A to 2F are exemplary alternative exit surfaces.
Figure 2B:
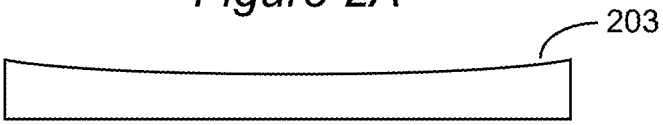
Figure 2C:
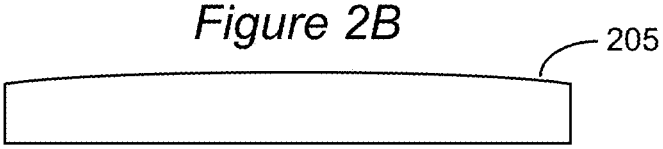
Figure 2D:
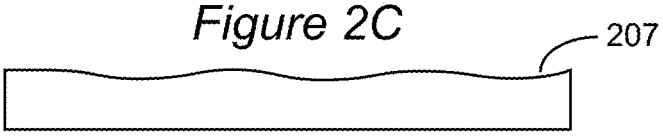
Figure 2E:
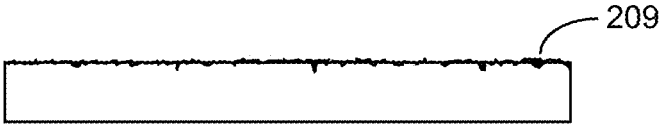
Figure 2F:
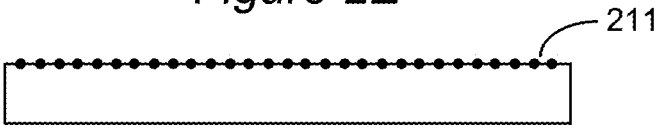

FIG. 1 is a schematic illustration of a system assembly for producing fibers, e.g., fine or ultrafine fibers. An ultrasonic nozzle 101 is used as a spinning head and the exit of the nozzle 101 is pointed upwards, opposite the direction of Earth's gravity vector. A target 102, in this illustrative example a stage of stacked ring-plates 121, is positioned above the nozzle 101 and used for fiber collection and to keep as-produced fibers for further fiber drying and easing of the fiber harvesting. The upward facing orientation of the nozzle exit contributes to multiple desirable results. The upward orientation allows electrospun polymer solution to form a convex meniscus at the nozzle exit surface. In addition, bubbles such as those formed by cavitation induced by acoustic energy will naturally rise in the direction opposite of gravity's vector and toward the liquid-gas interface atop of the meniscus of solution.

Structurally, the exemplary nozzle 101 includes a lower body 103, a support 104 (e.g., a support column), and a disk 105 the top surface of which forms an exit surface (or jetting surface) 106. One or more channels 107, such as capillaries, conduct the material to be jetted through the channel 107 from a reservoir 108 to the exit surface 106 of the disk 105. The material or materials which ultimately form the spun fibers may vary among embodiments. For convenience and consistency of discussion, the terms "solution" and "liquid" will be used frequently in this description. However, it should be appreciated that the use of the terms "solution" and "liquid" is representative, and these terms are generally interchangeable for alternatives which will occur to those of skill in the art. For example, spin solution, polymer solution, liquid polymer, liquid, melt, and other variations and combinations of these terms and expressions may be used to describe the medium that is being electrospun by an exemplary system like that depicted by FIG. 1.

For the operation of the assembly in FIG. 1, the nozzle 101 is connected to the electrical ground 111, and the fiber collection stage 102 is on a DC/AC high voltage supplied from a voltage source 112. However, some embodiments may be configured with the opposite voltage arrangement. That is to say the nozzle 101 may be connected to the relatively high voltage source 112, and the target 102 may be connected to ground 111. In either configuration, the voltage differential between nozzle 101 and target 102 establishes an electric field in the intervening space and facilitates the jetting of the solution from the exit surface 106 toward the target 102 from which the fibers may be subsequently collected. In a further variation of this setup, the electric field in the space between the nozzle 101 and target 102 may be created by one more elements other than the nozzle 101 and/or the target 102. The one or more other elements may be, for example, a first charged surface and/or a second surface of different charge characteristics to the first (e.g., grounded or oppositely charged and/or simply charged to a different magnitude), where such first and/or second surface do not (or does not) belong to either the nozzle 101 or the target 102.

The distance between the nozzle 101 and the target 102 may vary among embodiments. As a non-limiting example, the distance may be in the range of 2.5 to 12 inches, or 2.5 to 8 inches, or 3.5 to 4 inches. The voltage differential may also vary among embodiments. As a non-limiting example, 10-30 kV or 15-20 kV differential may be applied.

Once the solution is fed through the nozzle 101 by channel 107, a liquid meniscus 114 (e.g., in a generally convex shape) is established on the exit surface 106 due to the surface tension of the solution. An acoustic energy source such as an ultrasonic generator 113 is arranged to vibrate the exit surface 106 to form the liquid into a standing wave on the exit surface and contribute to the induction of jetting of the liquid as multiple fibers 116. By vibrating the liquid meniscus 114 at an ultrasonic frequency, waves are developed at the liquid-gas interface, and the peaks of the interfacial wave serve as locations for solution jetting. In addition, the ultrasonic vibration and gentile heating due to the ultrasonic waves reduce the surface tension of the solution. The acoustic energy's contribution to a reduction in surface tension of the solution may be relied upon to reduce the voltage differential otherwise required for multiple jetting. Benefits of reduced voltage include reduced energy consumption for production and a lower risk of damage to the electrospinning components. The breakdown of surrounding gas exposed to the electric field also sets a limit to the max voltage which can be applied during an electrospinning process. The arcing voltage forming the upper limit of voltage for electrospinning varies depending on various aspects of the electrospinning setup. A reduced voltage requirement for production reduces the risk of reaching this threshold.

The assembly depicted by FIG. 1 further includes a feedback control system for tuning the fiber production process. The feedback control system includes one or more cameras 122 positioned to monitor one or more of the exit surface 106, liquid meniscus 114, the wave patterns on the liquid meniscus 114 which result from the energy supplied by ultrasonic generator 113, and the fibers 116 being jetted. The data from the camera 122 is a feedback signal provided to one or more controllers 123. A controller 123 may be, for example, one or more microprocessors or processors belonging to, e.g., one or more computers, servers, or the like. The controller 123 monitors the feedback signal for changes in the standing wave induced by the acoustic vibrations and/or changes in the fiber jetting positions relative to, e.g., the exit surface. The controller 123 may be configured to automatically detect fluctuations or variations in the standing wave from the feedback signal. The controller 123 may be configured to automatically trigger adjustments to vibration frequency and/or other parameters of the ultrasonic generator 113 to reduce or eliminate continued occurrence of the variations. The standing wave is thereby stabilized and the jetting positions are thus likewise stabilized.

The configuration of the exit surface and the structure to which it belongs, as well as how such structure is connected to the source (or sources) of acoustic energy may vary among embodiments to achieve particular certain advantageous effects on the jetting of fibers from the exit surface. In the example supplied by FIG. 1, the exit surface 106 is a top surface of the disk 105. The support 104 is connected to a bottom side of the disk 105 and lies between the exit surface 106 and the application site 115 of ultrasonic vibration to the nozzle 101. As a result, the acoustic energy must pass through support 104 to reach the exit surface 106. The edges of disk 105 extend laterally beyond the topmost part of the support 104, with the support contacting the disk 105 only at a center position and not at the edges. In some embodiments, some up to all (an entirety) of a circumferential edge of the exit surface (in this case the edge of disk 105) extends over the topmost part of the support 104. This configuration, together with the arrangement that acoustic energy must pass through the support 104 to reach disk 105, has the result that vibration on the exit surface 106 originates from a center of the exit surface 106 and emanates from the center toward the edges. Lateral waves form on the surface of the disk 105. This configuration is desirable in some embodiments to provide a desired intensity of the vibration to the fluid atop the exit surface 106. In some embodiments the disk 105 may be characterized instead or additionally as a plate, a platform, or the like.

A distinct disk 105 may be omitted in some embodiments. In such a case the top surface of the support 104 may form the exit surface 106. The lower body 103 provides a site for connection of the nozzle 101 with other components of some embodiments. In some embodiments the lower body 103 may be omitted, however. Some nozzle embodiments are characterizable as needle-less, in contrast to many existing electrospraying heads.

In some embodiments, a heated dry air 117 may be provided, e.g., through an annular channel 118 surrounding the nozzle 101 to dry fibers after they are produced.

FIGS. 2A-2F illustrate a variety of alternative exit surface configurations. The exit surface of an exemplary ultrasonic nozzle may be, for example, either flat like exit surface 201 in FIG. 2A, concave such as exit surface 203 in FIG. 2B, convex such as exit surface 205 in FIG. 2C, waved such as exit surface 207 in FIG. 2D, roughed such as exit surface 209 in FIG. 2E, and/or patterned such as exit surface 211 in FIG. 2F. Patterning may be achieved by, for example, grooves, dimples, ridges, embosses, or some combination of these and/or other features. For simplicity of illustration, FIGS. 2A-2F should be understood as cross-sections of a an exemplary nozzle disk, and channels for conducting fluid to the exit surface as well as the support column beneath each disk are omitted (see FIG. 1 for exemplary illustration of such features). Some embodiments may include one or more disks which include some combination of the qualities of the exit surfaces depicted by FIGS. 2A-2F.

Figure 3A:
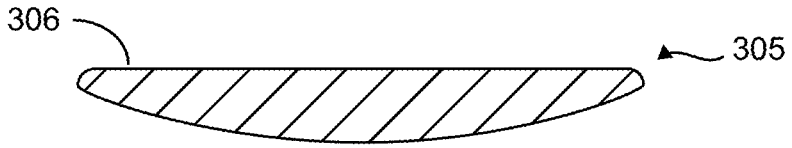
FIGS. 3A and 3B are exemplary alternative thickness configurations of a jetting disk.
Figure 3B:
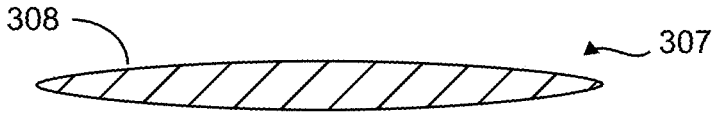

In FIG. 1, the disk 105 has a substantially constant thickness except for a thinning at the edges where the edges are rounded slightly. In some embodiments, part or an entirety of the circumferential edge of a disk (e.g., disk 105 of FIG. 1) of an exemplary nozzle may be thinner than a center part of the disk. As illustration of some alternatives, FIG. 3A shows a disk 305 with a flat exit surface 306 yet a thickness which reduces gradually from the center of the disk toward the circumferential edges of the disk. FIG. 3B, on the other hand, shows a disk 307 with a convex exit surface 308, yet the disk 307 shares the quality of disk 305 of a gradual reduction in thickness from the center of the disk toward the circumferential edges of the disk. A disk edge thinner than a disk center may be used in some embodiments to enhance the vibration of the exit surface and thus the liquid on top of the exit surface. The thinning may be sudden or stepwise, but generally a gradual thinning is desirable for many exemplary embodiments. For simplicity of illustration, FIGS. 3A and 3B omit illustration of channels for conducting fluid to the exit surface as well as the support column beneath each disk.

Figure 4:
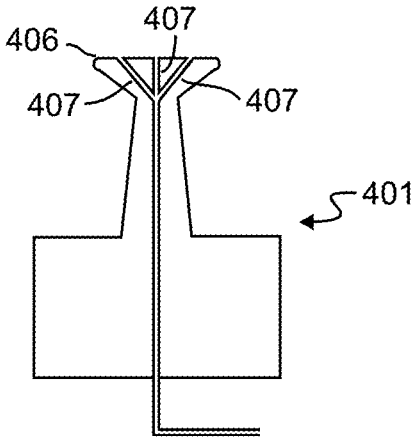
FIG. 4 is an exemplary nozzle with a plurality of channels which simultaneously deliver fluid to the exit surface.

FIG. 4 illustrates an exemplary nozzle 401 comprising a plurality of channels 407 which simultaneously deliver fluid to the exit surface 406. Channel positions and flow rates may be selected so that a separate liquid meniscus forms at each channel exit, or else so that the liquids from the separate channel exits flow together such as to form a single liquid body atop a large area of the exit surface. The separate channels may branch from a single channel, as depicted in FIG. 4, or may have paths which are entirely fluidically isolated from one another for their lengths within the body of the nozzle.

Figure 5:
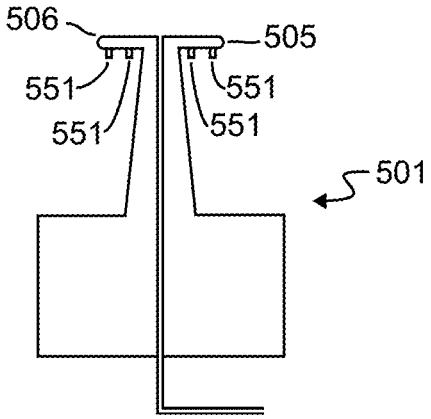
FIG. 5 is an exemplary nozzle comprising ultrasonic sources attached to a bottom side of the disk that provides the exit surface.

FIG. 5 depicts yet another exemplary nozzle 501 in which a plurality of separate acoustic sources 551 are provided. In addition, FIG. 5 demonstrates positioning of the acoustic sources on a bottom of the disk 505 which forms the exit surface 506 for electrospinning. The number and arrangement of the acoustic sources 551 may be selected to achieve a particular desired vibrational pattern on the exit surface 506 with advantages such as but not limited to maximizing jetting efficiency. The closer positioning of the acoustic sources 551 to the exit surface 506 (contrasted with position 115 of FIG. 1 for example), may provide cavitation sites closer to the exit surface with correspondingly greater control over the bubbles which ultimately reach the liquid-air interface of the fluid atop the exit surface.

Figure 6:
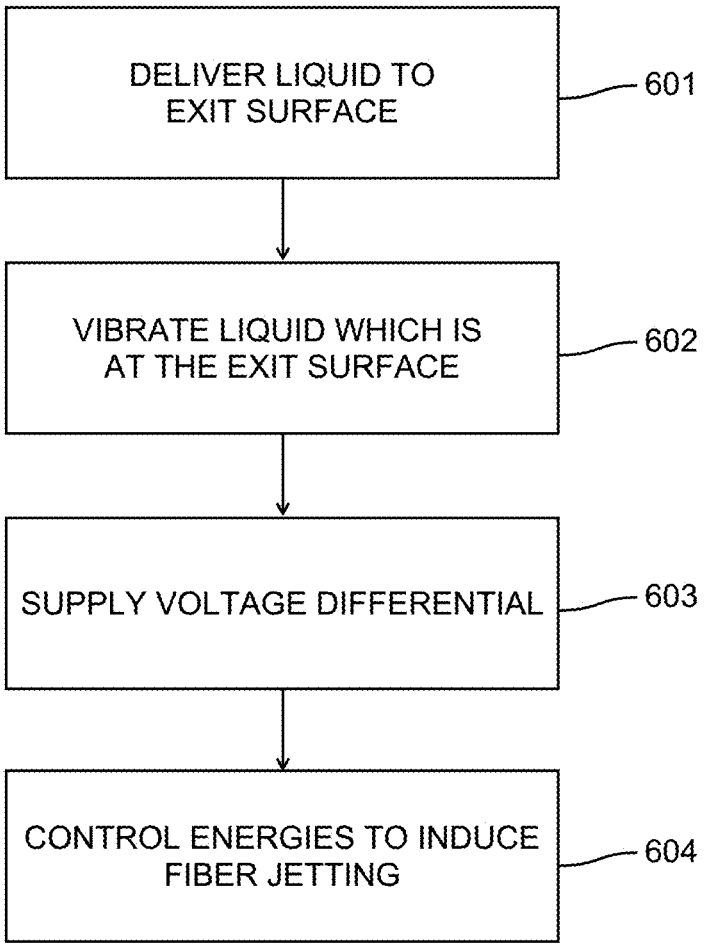
FIG. 6 is an exemplary method of electrospinning.

An exemplary method of electrospinning is summarized by FIG. 6. At step 601, liquid is delivered to the exit surface of one or more nozzles. At step 602, the liquid which is at the exit surface is vibrated so the liquid forms into a standing wave on the exit surface of the nozzle. The vibrations may be supplied by acoustic sources, in particular ultrasonic energy sources in some embodiments. The position of the one or more acoustic sources may vary among embodiments, and the vibrations may be induced in liquid which is not yet delivered to the exit surface in addition the liquid which has already reached the exit surface. The acoustic energy for the vibrations may be produced at one or more frequencies, especially one or more ultrasonic frequencies or frequency ranges, and with sufficient amplitude to produce the standing wave. Non-limiting examples of acceptable frequencies for some embodiments include but are not limited to frequencies which meet one or more of the following conditions: above 18 KHz, above 20 KHz, above 30 KHz, above 40 KHz, above 50 KHz, above 60 KHz, above 70 KHz, above 80 KHz, below 20 MHz, below 10 MHz, below 5 MHz, below 1 MHz, below, below 500 KHz, below 400 KHz, below 300 KHz, below 200 KHz, below 100 KHz, below 90 KHz, below 80 KHz, below 70 KHz, below 60 KHz, below 50 KHz, and below 40 KHz. Exemplary ranges may include but are not limited to ranges established by any pairing of the lower and upper limits listed in the preceding sentence. At step 603, a voltage differential is established between the exit surface and a target, e.g., a fiber collection stage. At step 604, the energies supplied by the vibrating step and the voltage differential are controlled, e.g., with respect to one or parameters such as but not limited to amount, amplitude, frequency, and/or level, to induce jetting of the liquid at the exit surface as electrospun fibers from one or more peaks of the standing wave. These fibers are collected at target. It should be appreciated that generally speaking, the steps 601-604 depicted by FIG. 6 are all conducted concurrently with one another.

The vibrating of step 602 may comprise the production of gas bubbles in the liquid from cavitation. The vibrating also assists the gas bubbles to move to a liquid-gas interface atop the standing wave at the exit surface. The characteristics of the energy supplied by the vibrating step 602 are selected such that cavitation is the cause of the bubbles, in contrast to bubble injection. While some embodiments may include bubble injection, an advantage of many exemplary embodiments is that bubbles may be deliberated produced without any bubble injection. At a high vibration energy, gas bubbles may be created due to the cavitation in spun solutions. The vibration then assists gas bubbles quickly moving to the liquid-gas interface. Under the above condition, more jetting from the solution meniscus occurs. Generally, the energies controlled at step 604 are such that multiple jetting occurs, with individual fibers being produced from each of a plurality of peaks of the standing wave.

Exemplary embodiments may produce fine and ultrafine fibers for various applications, including but not limited to, filtration and separation, material research, patch drug delivery via patch/mat, biological scaffolds, and many others. As one example, ultrafine fibers may be produced and incorporated in filtration media to reduce the pressure drop of media while keeping or improving the particle filtration efficiency of the media. As another example, a thin layer of ultrafine fibers may be placed at a filtration surface of industrial filter cartridges to improve the cleaning efficiency of reverse pulsed flow cleaning processes.

Larger sized fibers may be achieved by increasing solution viscosity. One way to increase solution viscosity is to increase polymer concentration in the solution. Larger sized fibers may also be achieved by increasing feed flowrate.

Example

This example demonstrates the modification and repurposing of a commercially available electrospray nozzle to instead produce fibers by an exemplary electrospinning process. The ultrasonic-assisted electrospinning process takes advantage of ultrasound-assisted and bubble electrospinning to produce fine and ultrafine fibers. An ultrasonic nozzle was used as the spinneret in this new electrospinning process. Under the action of ultrasonic vibration, a rippled surface was formed on the meniscus of spun polymer solutions at the nozzle exit. With the presence of divergent electrical field, multiple fibers were emitted from the rippled meniscus surface. At a higher frequency, the cavitation of the solvent would occur, resulting in tiny gas bubbles. These gas bubbles would quickly move to the meniscus surface, attributable to the vibration. Under these circumstances, multiple fibers were produced. The results show that the new approach is capable of producing polymer fibers in super- and sub-micrometer size ranges with various means for controlling final fiber sizes.

Figure 7:
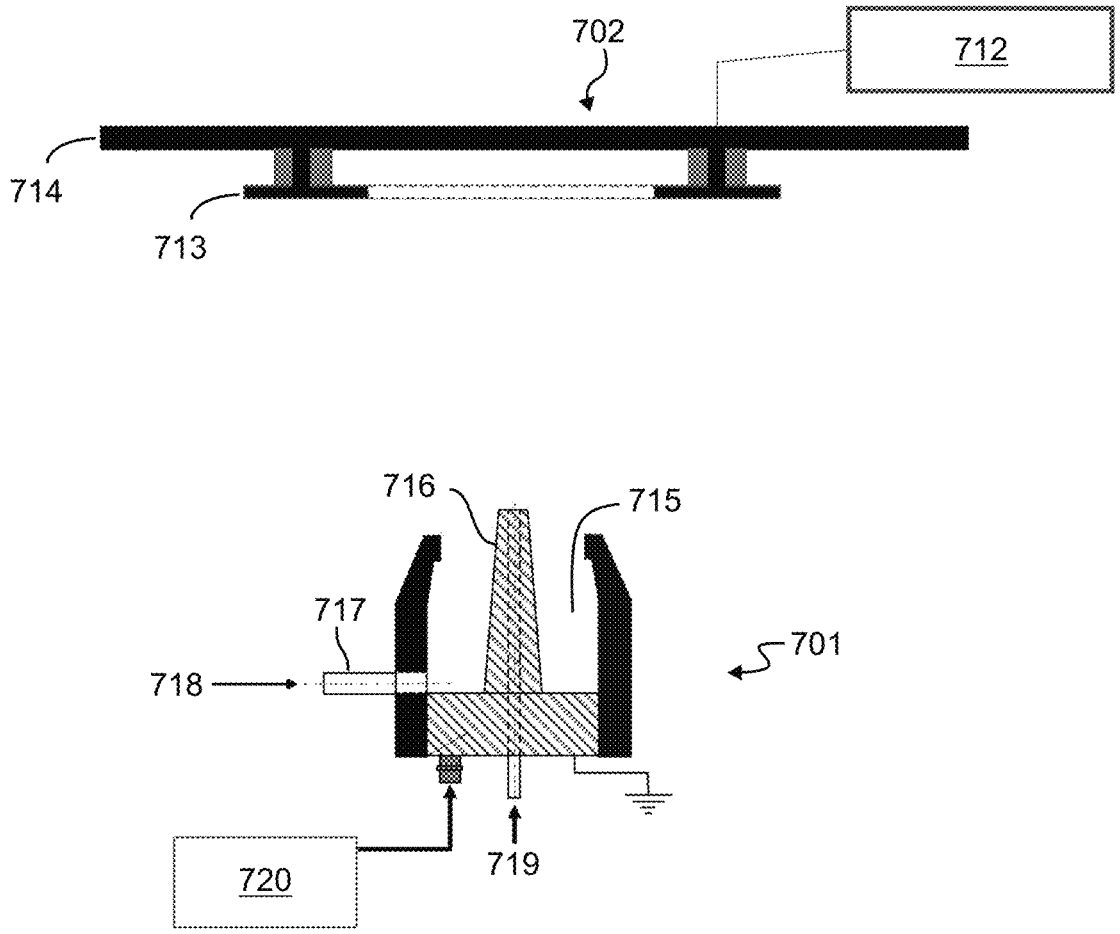
FIG. 7 is a schematic diagram of the experimental setup for ultrasonic-assisted electrospinning described in the Example.

FIG. 7 shows a schematic diagram of the experimental setup used in this example. A focused ultrasonic spray nozzle 701 having a vibration frequency of 60 kHz (MicroSpray by AKS) was selected. Different from a typical nozzle positioning which points the nozzle exit downwards, the ultrasonic nozzle used in this example was arranged to have the nozzle exit upwards, allowing electrospun polymer solution to form a convex meniscus at the nozzle exit surface. An electric field was then established between the nozzle 701 and fiber collection substrate 702. To prevent the nozzle 701 from damage by the potential electrical discharging (due to the application of high voltage), the nozzle was electrically grounded, and a DC high voltage from a power supply 712 (Bertan H.V. power supply 203-30R) was applied at the fiber collection substrate 702. The exemplary collection substrate 702 was constructed by hanging a metal disk 713 (with a central hole of 5 inch) from a supporting metal plate 714 (of rectangular shape) covered by plastic insulation. The metal disk and supporting plate were electrically connected to one another. The substrate construction allowed for easy harvesting of fibers after each experimental run. The distance between the nozzle 701 and the supporting plate 714 could be varied by moving the plate along two plastic rods having the diameters of 2.0 inch. In this example, the distance between the nozzle 701 and the collection substrate 702 was kept at 3.5-4 inch and 15-20 k V was applied to the collection substrate 702.

In addition, the feature of a shrouding air was included in the nozzle as depicted by FIG. 7. The shrouding air feature was originally designed to focus droplets into a narrow aerosol jet. An annular chamber 715, enclosing the nozzle stem 716, is constructed for the air injection from the inlet tubing 717 and air shrouding from the chamber exit. In this example, the shrouding air (dry sheath air) 718 was applied as a flow to dry produced fibers instead of its original focusing function. To minimize the focusing effect of the shrouding air, the ultrasonic nozzle tip exit was further protruded out from the chamber exit of shrouding air. A programmable syringe pump (Harvard Apparatus Model 4200-015) was used to feed polymer solution 719 into the ultrasonic nozzle 701. An ultrasonic generator 720 supplied ultrasonic energy at a base of the nozzle 701.

The polymer solutions to be electrospun were prepared by dissolving Polyacrylonitrile (PAN, mw 150,000 Sigma-Aldrich) polymer in a solvent of N.N.-Dimethylformamide (DMF, 99.8% Aldrich). The polymer solutions of 6, 8, 10, 12 and 14% wt were prepared for this example. The viscosities of the prepared PAN solutions were characterized by a viscometer. The measured rheological property of prepared solutions in different PAN concentrations evidenced that the specific viscosity of prepared PAN solutions increased as the PAN concentration in the DMF solvent increased. Specifically the viscosity of polymer solutions increases proportionally to the percentage of polymer in solutions.

A scanning electron microscope (SEM, Hitachi FE-SEM Su-70) was applied to qualitatively characterize fibers produced by the ultrasonic-assisted electrospinning process. The size distributions of fibers electrospun with different solutions were obtained by analyzing the SEM images by the ImageJ software.

Figure 8:
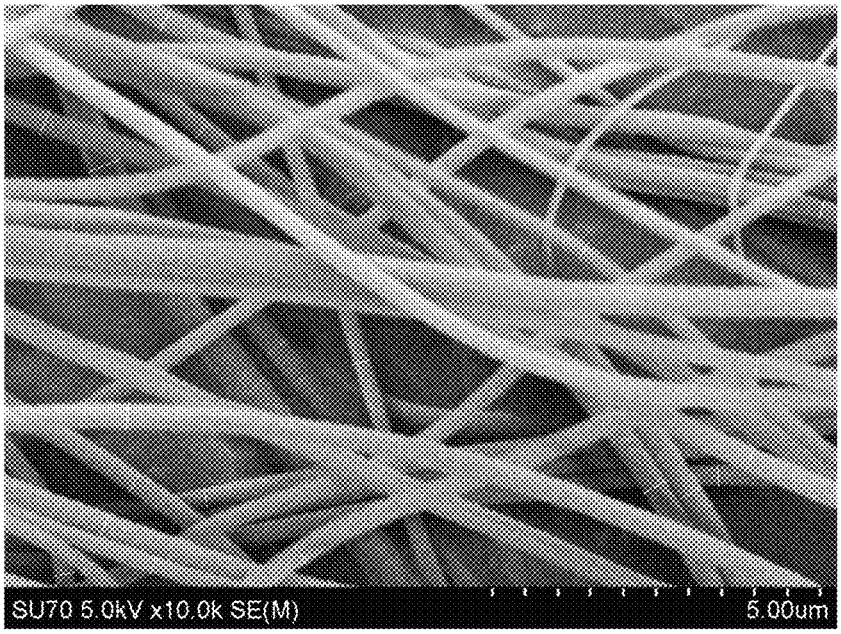
FIG. 8 is an SEM image of fibers produced by ultrasonic-assisted electrospinning using a polyacrylonitrile (PAN) solution of 8% wt.
Figure 9:
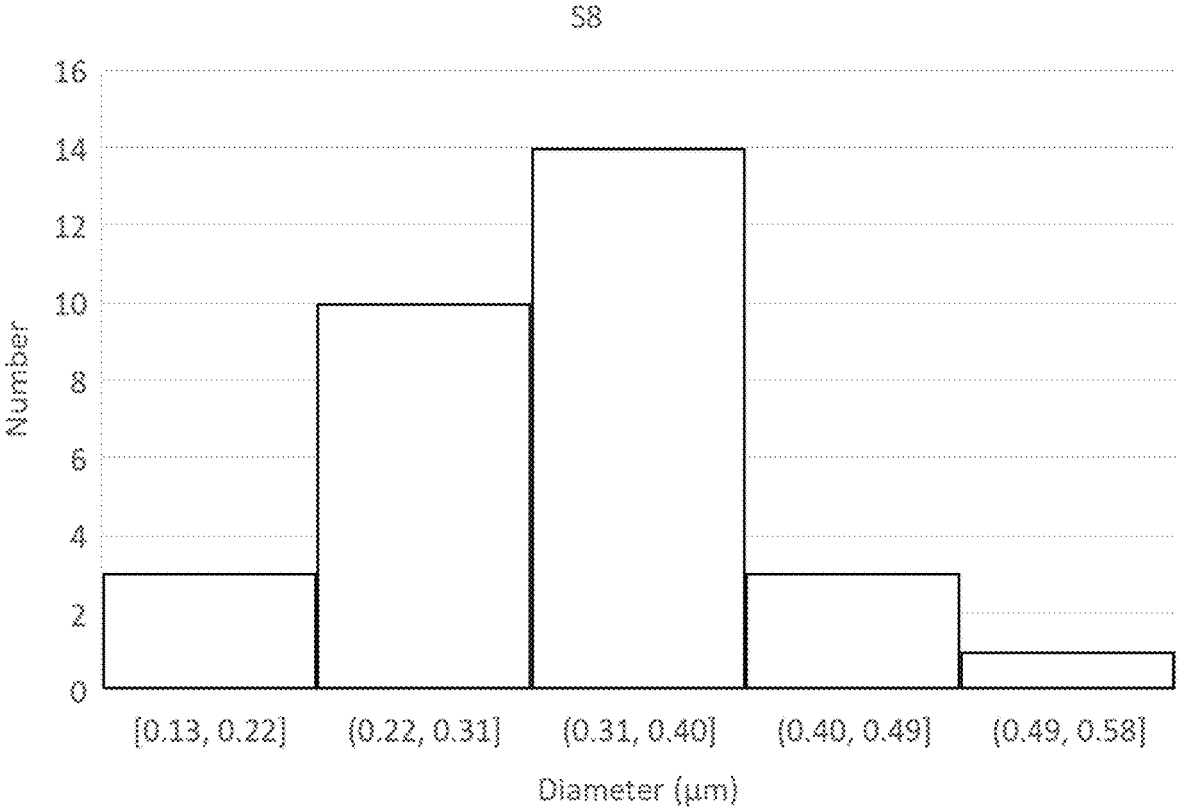
FIG. 9 shows fiber size distribution assessed from the FIG. 8 SEM image using ImageJ software.

FIG. 8 shows a typical SEM image of fibers produced by the ultrasonic-assisted electrospinning using the PAN solution of 8% wt. A voltage of 18.5 kV was applied to the collection substrate and the feeding solution flowrate was 60 μl/min. The SEM image evidences that fine fibers were produced by the ultrasonic-assisted electrospinning. Based on the ImageJ analysis of the FIG. 12 fiber image, the mean sizes of fibers was 0.326 μm with a standard deviation of 0.082 μm. The number of fibers in each diameter range is depicted by FIG. 9.

Figure 10:
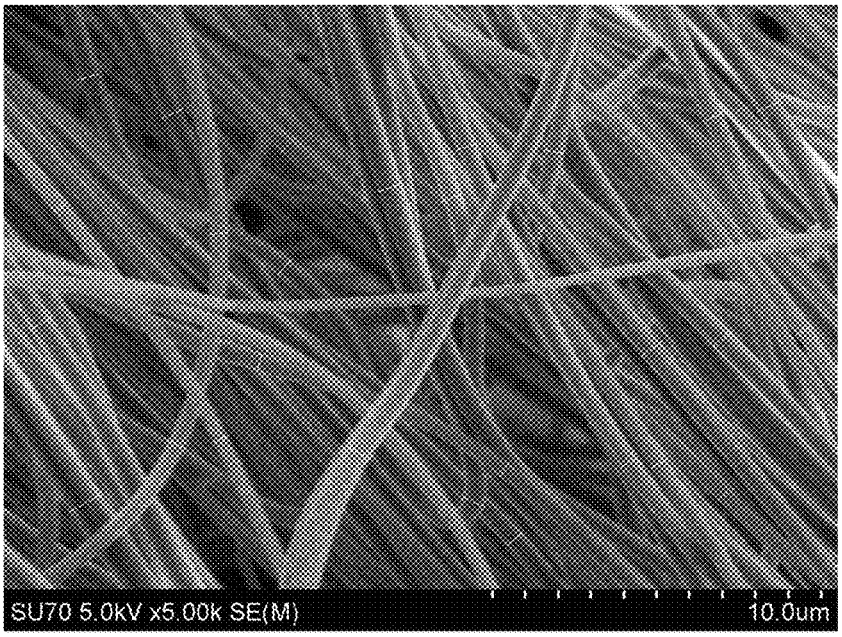
FIG. 10 is an SEM image of fibers produced by ultrasonic-assisted electrospinning using a PAN solution of 10% wt.
Figure 11:
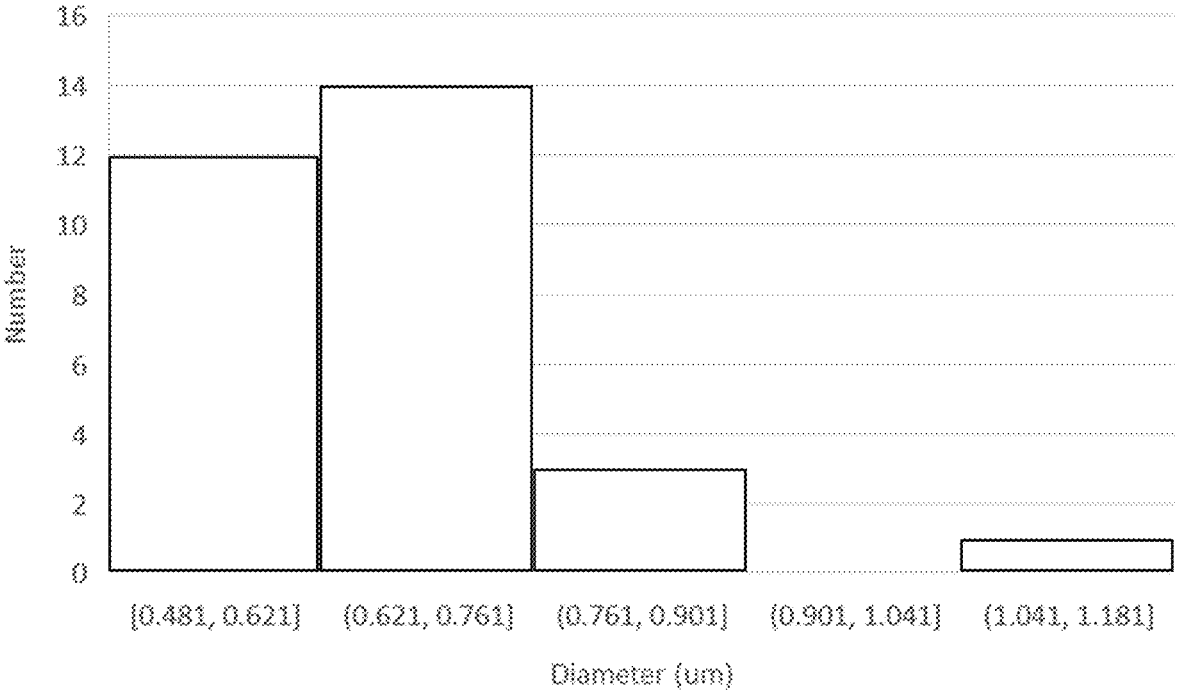
FIG. 11 shows fiber size distribution assessed from the FIG. 10 SEM image using ImageJ software.

FIG. 10 shows an SEM image of fine fibers produced when ultrasonic electrospinning 10% PAN polymer in DFM solvent. FIG. 11 shows the number of fibers in respective diameter size ranges based on image analysis of the SEM image of FIG. 10. The mean size of fibers produced is approximately 0.64 μm.

Figure 12:
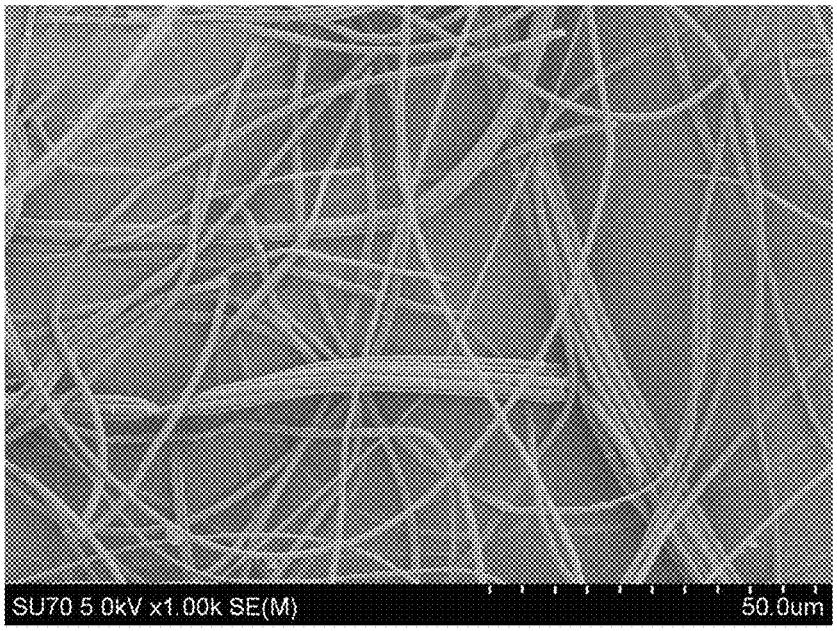
FIG. 12 is an SEM image of fibers produced by ultrasonic-assisted electrospinning using a PAN solution of 14% wt.
Figure 13:
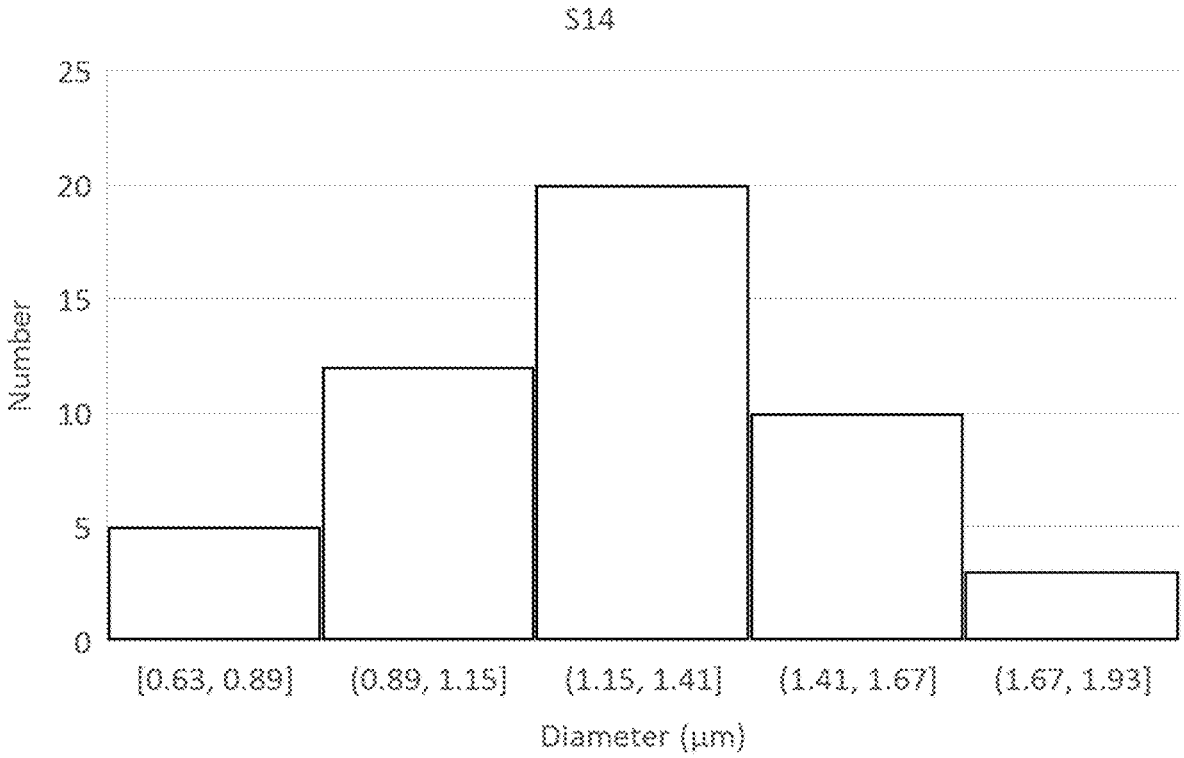
FIG. 13 shows fiber size distribution assessed from the FIG. 12 SEM image using ImageJ software.

FIG. 12 shows the SEM image of fibers in the case of 14% wt PAN solution. The feeding flowrate was kept at 60 μl/min. In this case, fibers in the super-micrometer sizes were produced. FIG. 13 shows the number of fibers in respective diameter size ranges based on image analysis of the SEM image of FIG. 12. The mean size and standard deviation of fibers in this sample were 1.255 μm and 0.273 μm, respectively. Since all the operational parameters were kept unchanged, the increase of the fiber size in this sample is attributed to the increase of solution viscosity. The viscosity of the 14% wt PAN solution was dramatically greater compared to that for the 8% wt PAN solution.

To investigate the effect of polymer concentration and feeding flow rate on the size of fibers produced by ultrasonic-assisted electrospinning, the concentration of PAN was varied in the solutions: 6, 8, 10, 12, and 14%. For each electrospun solution, the feeding flowrate was varied. Specifically flowrates of 60 and 120 μl/min were used.

Figure 14:
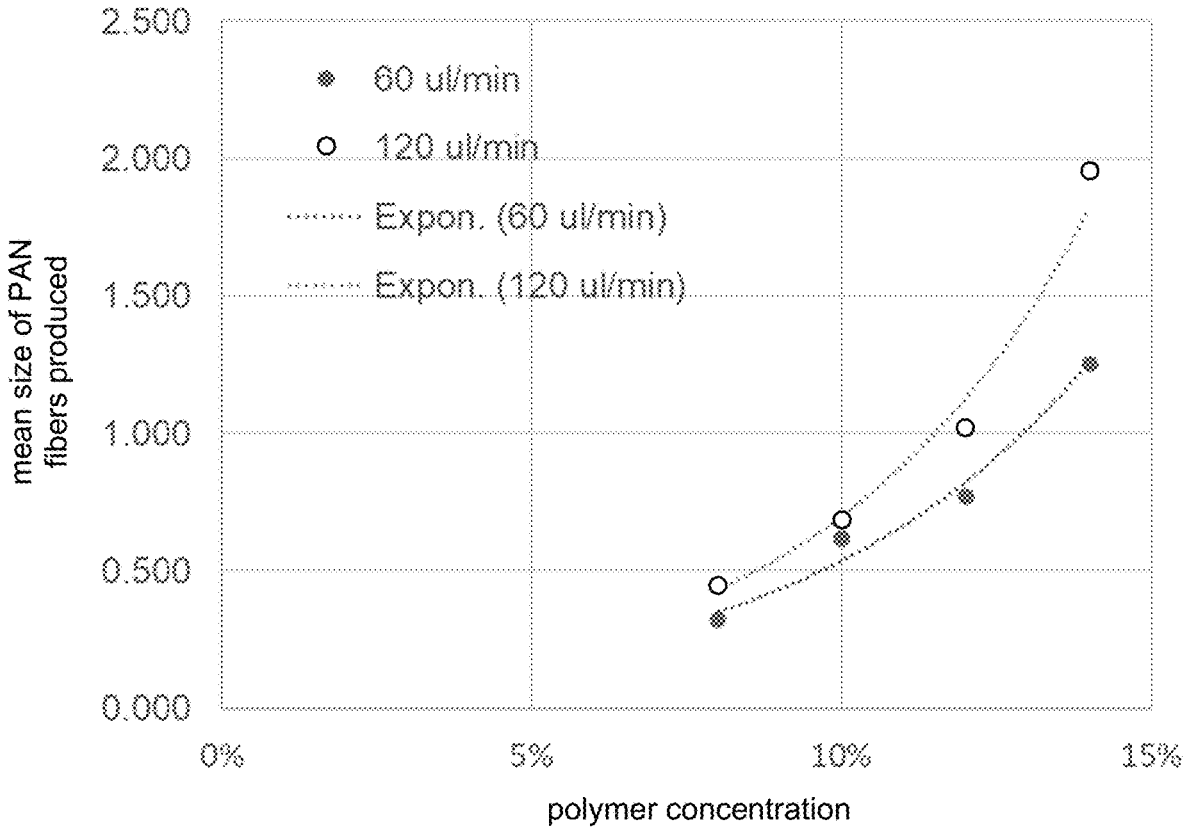
FIG. 14 shows mean size of PAN fibers produced by ultrasonic-assisted electrospinning as a function of polymer concentration at a specific feeding flowrate.

FIG. 14 shows the mean size of fibers produced by the proposed electrospinning as a function of polymer concentration in the DMF solvent for the two selected feeding flowrates. As shown in FIG. 14, the fiber sizes increased as the polymer concentration increased for a given feeding flowrate. This increase is attributed to the viscosity of the electrospun solutions, which dramatically increased as the polymer concentration increased. FIG. 14 further shows that the fiber size increased as the feeding flowrate increased for each given PAN polymer solution.

Where a range of values is provided in this disclosure, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are described.

As used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely", "only", and the like in connection with the recitation of claim elements, or use of a "negative" limitation.

As will be apparent to those of skill in the art upon reading this disclosure, each of the individual embodiments described and illustrated herein has discrete components and features which may be separated from or combined with the features of any of the other several embodiments without departing from the scope or spirit of the present invention. Any recited method can be carried out in the order of events recited or in any other order which is logically possible.

While exemplary embodiments of the present invention have been disclosed herein, one skilled in the art will recognize that various changes and modifications may be made without departing from the scope of the invention as defined by the following claims.

What is claimed is:

1. A method of electrospinning, comprising conducting a liquid through one or more channels to an exit surface of one or more electrospinning nozzles;

vibrating the exit surface with acoustic energy, the exit surface passing the acoustic energy to the liquid on the exit surface so the liquid forms into a standing wave on the exit surface of the one or more electrospinning nozzles;

supplying a voltage differential between the exit surface and a target; and controlling the acoustic energy and the voltage differential to induce jetting of the liquid as electrospun fiber from one or more peaks of the standing wave.

2. The method of claim 1, wherein the vibrating step comprises producing gas bubbles in the liquid from cavitation, wherein the vibrating assists the gas bubbles to move to a liquid-gas interface atop the standing wave.

3. The method of claim 2, further comprising multiple jetting of the liquid from a plurality of peaks of the standing wave.

4. The method of claim 1, further comprising forming a convex meniscus of the liquid at the exit surface.

5. The method of claim 1, wherein the liquid is conducted through the exit surface for delivery to the exit surface.

6. The method of claim 1, further comprising configuring the exit surface and structure to which the exit surface belongs from among alternative configurations to achieve particular effects on jetting of fibers from the exit surface.

7. The method of claim 1, wherein the exit surface is a top surface of a disk.

8. The method of claim 7, wherein a circumferential edge of the disk is thinner than a center of the disk.

9. The method of claim 8, wherein the disk tapers in thickness from the center toward the circumferential edge.

10. The method of claim 1, further comprising monitoring a feedback signal for the electrospinning and adjusting the acoustic energy based on the feedback signal.

11. The method of claim 1, wherein vibration on the exit surface originates from a center of the exit surface and emanates from the center toward edges of the exit surface.

12. The method of claim 1, wherein the voltage differential is 10-30 kV.

13. The method of claim 1, further comprising heating the liquid with the ultrasonic energy to reduce surface tension.

* * * * *